US011815843B2

(12) United States Patent
Imai

(10) Patent No.: US 11,815,843 B2
(45) Date of Patent: Nov. 14, 2023

(54) IMAGE FORMING APPARATUS AND CONTROL METHOD OF IMAGE FORMING APPARATUS

(71) Applicant: CANON KABUSHIKI KAISHA, Tokyo (JP)

(72) Inventor: Seijiro Imai, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/827,210

(22) Filed: May 27, 2022

(65) Prior Publication Data

US 2022/0382207 A1 Dec. 1, 2022

(30) Foreign Application Priority Data

May 31, 2021 (JP) ..... 2021-091610

(51) Int. Cl.
*G03G 21/12* (2006.01)
*G03G 15/00* (2006.01)

(52) U.S. Cl.
CPC ..... *G03G 21/12* (2013.01); *G03G 15/556* (2013.01); *G03G 2215/0888* (2013.01)

(58) Field of Classification Search
CPC ..... G03G 21/12; G03G 15/556; G03G 2215/0888
USPC ..... 399/35
See application file for complete search history.

(56) References Cited

U.S. PATENT DOCUMENTS

2011/0091227 A1* 4/2011 Tomita ..... G03G 21/12 399/35
2014/0186063 A1* 7/2014 Hogan ..... G03G 15/55 399/35
2017/0146945 A1* 5/2017 Takeuchi ..... G03G 15/556
2021/0302876 A1* 9/2021 Miura ..... G03G 21/12

FOREIGN PATENT DOCUMENTS

JP 2010117675 A 5/2010
WO WO-2021183177 A1 * 9/2021

* cited by examiner

*Primary Examiner* — Walter L Lindsay, Jr.
*Assistant Examiner* — Philip T Fadul
(74) *Attorney, Agent, or Firm* — Canon U.S.A., Inc. IP Division

(57) ABSTRACT

An image forming apparatus includes a plurality of light sources, a light source control unit that controls turning on and off of the plurality of light sources, a first detection unit that detects an accumulated amount of waste toner with respect to the total capacity of the first waste toner container, and a second detection unit that detects an accumulated amount of waste toner with respect to the total capacity of the second waste toner container. The light source control unit turns on one of the plurality of light sources, based on detection results of the first detection unit and the second detection unit.

13 Claims, 6 Drawing Sheets

FIG. 4

| No | STATE OF WASTE TONER CONTAINER A (CURRENT DISCHARGE DESTINATION) | STATE OF WASTE TONER CONTAINER B | LIGHTING STATE OF PATLITE |
|---|---|---|---|
| 1 | NOT NEAR-FULL | NOT NEAR-FULL | GREEN |
| 2 | NOT NEAR-FULL | NEAR-FULL | GREEN |
| 3 | NOT NEAR-FULL | FULL | GREEN |
| 4 | NOT NEAR-FULL | NO BOTTLE | GREEN |
| 5 | NEAR-FULL | NOT NEAR-FULL | GREEN |
| 6 | NEAR-FULL | NEAR-FULL | ORANGE |
| 7 | NEAR-FULL | FULL | ORANGE |
| 8 | NEAR-FULL | NO BOTTLE | ORANGE |
| 9 | FULL | NOT NEAR-FULL | GREEN |
| 10 | FULL | NEAR-FULL | ORANGE |
| 11 | FULL | FULL | RED |
| 12 | FULL | NO BOTTLE | RED |

GREEN: UNDER NORMAL EXECUTION

ORANGE: ADVANCE NOTICE OF SUSPENSION

RED: UNDER SUSPENSION

IMAGE FORMING APPARATUS AND CONTROL METHOD OF IMAGE FORMING APPARATUS

BACKGROUND

Field of the Disclosure

The present disclosure relates to an image forming apparatus and a control method of the image forming apparatus.

Description of the Related Art

Copying machines that perform printing with toner form a toner image on a photosensitive member, and then transfer toner onto a paper sheet that is a print medium. After the transfer, the toner having not been transferred onto the paper sheet may be adhered as waste toner to the photosensitive member. The waste toner is removed by, for example, a brush or blade included in a cleaning device, and conveyed to a waste toner collection container. If the waste toner collection container becomes full, it is prohibited to continue printing to prevent the waste toner from flowing out of the container. In such a case, the user needs to replace the waste toner container, and cannot perform printing during the replacement of the container, which would lead to lower productivity. In order to prevent a reduction in productivity during the replacement of the waste toner container, Japanese Patent Application Laid-Open No. 2010-117675 discusses a copying machine equipped with a plurality of waste toner containers. If one container becomes full, the discharge destination of waste toner is switched to the other container, so that the user can continue printing during the replacement of the container.

In the configuration where a plurality of waste toner is provided and the discharge destination of waste toner is switched between them, however, it may be difficult to correctly display the state of a print job. Some recent copying machines announce the current state of the print job to the user by using a lighting state of a light equipped to the body of the copying machine during the execution of the printing. Examples of the state of a print job include "under print job execution", "under print job suspension", and "advance notice of print job stop".

In the configuration with a plurality of waste toner containers, the state of the print job may not be indicated properly in a case where the display of the print job state described above is controlled by referring to only one waste toner container state. When a waste toner container of which the storage state is referred to becomes full as an example, the discharge of waste toner to the waste toner container cannot be continued, and thus the light indicates that the print job is under suspension.

If the other waste toner container is not in a near-full state, however, long-time printing is still possible by changing the discharge destination. Nevertheless, the suspended state of the print job will be announced to the user. As a result, information different from the actual state of the print job is provided to the user.

SUMMARY

According to an aspect of the present disclosure, an image forming apparatus having at least a first waste toner container and a second waste toner container includes a plurality of light sources, a light source control unit that controls turning on and off of the plurality of light sources, a first detection unit that detects an accumulated amount of waste toner with respect to the total capacity of the first waste toner container, and a second detection unit that detects an accumulated amount of waste toner with respect to the total capacity of the second waste toner container. The light source control unit turns on one of the plurality of light sources, based on detection results of the first detection unit and the second detection unit.

Further features of the present disclosure will become apparent from the following description of exemplary embodiments with reference to the attached drawings.

BRIEF DESCRIPTION OF THE DRAWINGS

FIG. 4 is a diagram representing states of two waste toner containers and lighting patterns of the Patlite®.

DESCRIPTION OF THE EMBODIMENTS

Hereinafter, exemplary embodiments of the present disclosure will be described with reference to the accompanying drawings. The following exemplary embodiments are not intended to limit the disclosure according to the claims, and all of combinations of features described in relation to the exemplary embodiments are not necessarily essential to the solutions of the present disclosure. In the exemplary embodiments, an image processing apparatus is used as an example of an information processing apparatus, but the present disclosure is not limited to this.

Figure 1:
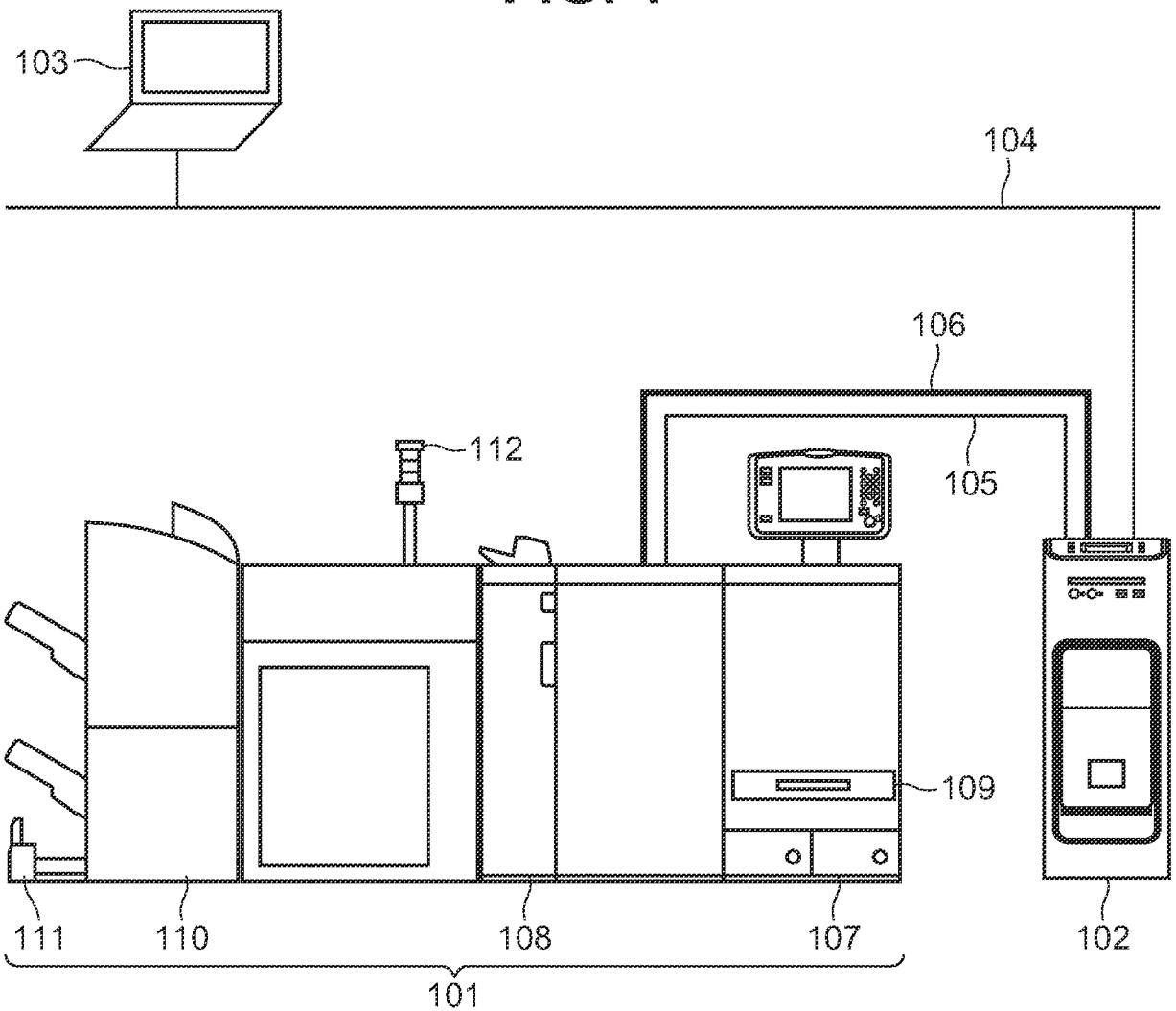
FIG. 1 is an overall view of a hardware configuration of a printing system.

FIG. 1 is an overall view of a hardware configuration of an image processing system according to a first exemplary embodiment. The image processing system includes an image forming apparatus 101 and an external controller 102. The image forming apparatus 101 and the external controller 102 are communicably connected together via an internal local area network (LAN) 105 and a video cable 106. The external controller 102 is communicably connected to a client PC 103 via an external LAN 104, and the client PC 103 issues a print instruction to the external controller 102.

The client PC 103 has a printer driver installed with the function of converting print data into a print description language processible by the external controller 102. The user who performs printing can issue a print instruction from various application programs via the printer driver. The printer driver transmits print data to the external controller 102 based on the print instruction from the user. Upon receipt of the print instruction from the client PC 103, the external controller 102 performs data analysis or rasterizing processing, and inputs the print data to the image forming apparatus 101 and instructs the image forming apparatus 101 to perform printing.

The image forming apparatus 101 will now be described. A plurality of devices having different functions is connected to the image forming apparatus 101 so that the image forming apparatus 101 can perform complicated print processes such as binding. A printing device 107 forms an image with toner on a paper sheet conveyed from a paper feed unit at the bottom of the printing device 107. The configuration and operating principle of the printing device 107 are as described below. A light beam, such as a laser light, modulated based on image data is reflected by a rotary polygonal mirror and is eradiated as scanning light to a photosensitive drum.

An electrostatic latent image formed on the photosensitive drum by the laser light is developed by toner, and the toner image is transferred onto a paper sheet stuck to a transfer drum. After the transfer of the toner image, toner remaining on the photosensitive drum is scraped off by a cleaning blade, and is conveyed to a waste toner container. This series of image forming process is executed in sequence with the toner of yellow (Y), magenta (M), cyan (C), and black (K), thereby forming a full-color image on the paper sheet. The paper sheet with the full-color image formed thereon on the transfer drum is conveyed to a fixing device. The fixing device includes a roller and a belt, and contains a heat source such as a halogen heater in the roller. The fixing device melts and fixes, by heat and pressure, the toner on the paper sheet to which the toner image has been transferred.

A waste toner container inlet 109 is a storage port to a waste toner container storage part included in the printing device 107. A waste toner container is stored through the storage port. The printing device 107 includes two waste toner containers illustrated in FIG. 6. If any of the waste toner containers become full, the user can open and close the storage port to replace the waste toner container.

Figure 6:
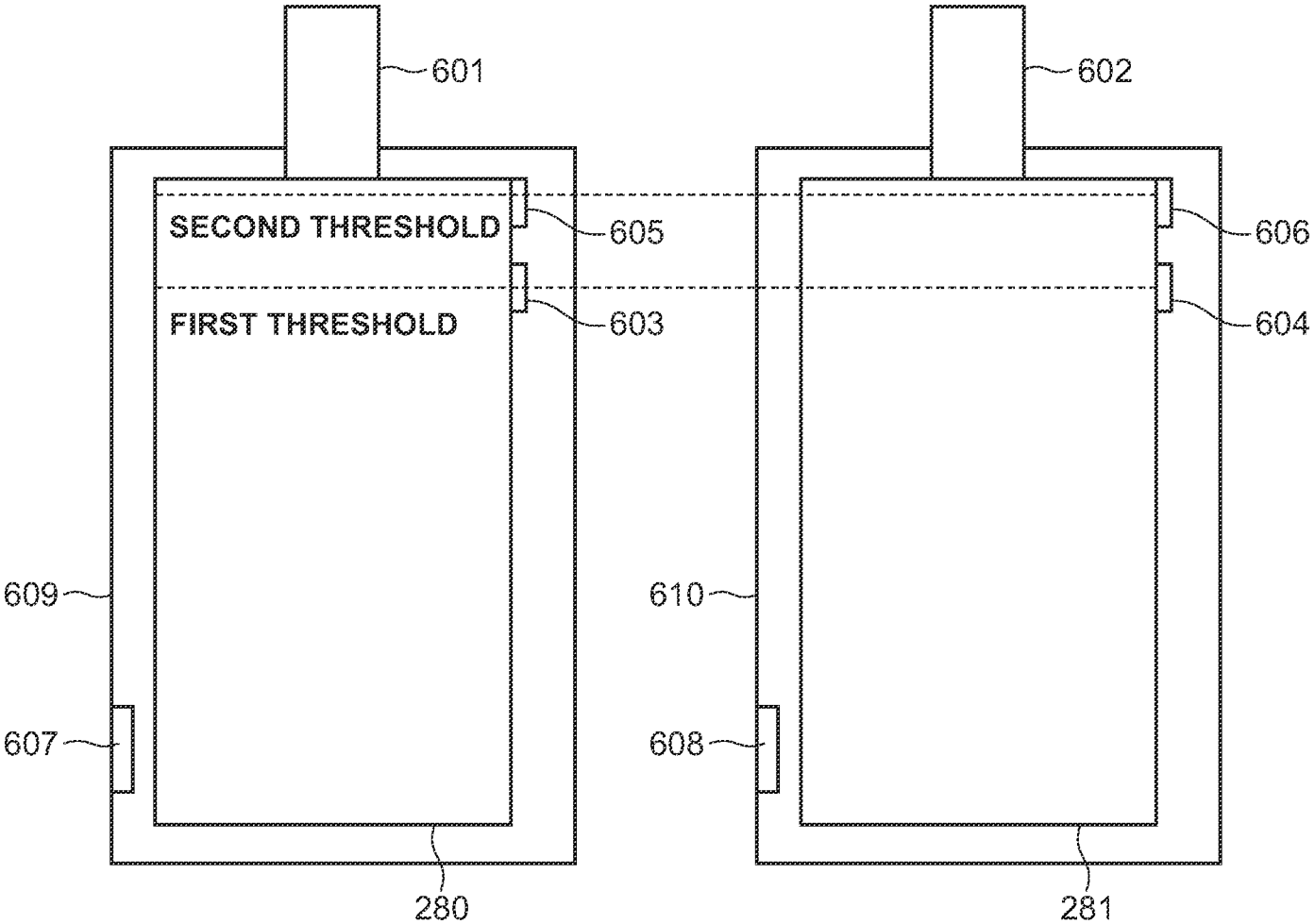
FIG. 6 is an explanatory diagram of the two waste toner containers.

FIG. 6 illustrates a state where waste toner containers 280 and 281 are respectively stored in waste toner storage parts 609 and 610. Waste toner container connection parts 601 and 602 are mechanisms that connect the waste toner containers to the printing device 107, and are connected to the toner cleaning mechanism in the printing device 107. A waste toner control unit 231 causes waste toner to be conveyed through the waste toner container connection parts 601 and 602 and stored in the waste toner containers 280 and 281.

A near-full level detection sensor 603 for detecting a near-full state and a full level detection sensor 605 for detecting a full state is connected to the waste toner container 280. A near-full level detection sensor 604 for detecting a near-full state and a full level detection sensor 606 for detecting a full state is connected to the waste toner container 281.

The near-full state is, for example, a state where waste toner is accumulated to a predetermined volume that is less than the total capacity of the waste toner container (i.e., ¾ or more of the container capacity). The full state is a state where waste toner is accumulated to a volume to a degree that the total capacity of the waste toner container is determined to be full.

A waste toner container detection sensor 607 detects whether the waste toner container 280 is inserted into the waste toner storage part 609. A waste toner container detection sensor 608 detects whether the waste toner container 281 is inserted into the waste toner storage part 610.

An inserter 108 is used to insert a sheet to be inserted. A paper sheet can be inserted at any position from the inserter 108 into a paper sheet group printed and conveyed by the printing device 107.

A large-capacity stacker 110 is capable of stacking a large volume of sheets. A finisher 111 is used to apply finishing process to the conveyed sheets. The finisher 111 can perform finishing process, such as stapling, punching, and saddle-stitch binding, and then discharges the processed sheets into a sheet discharge tray.

The printing system described above with reference to FIG. 1 is configured such that the external controller 102 is connected to the image forming apparatus 101. However, the present exemplary embodiment is not limited to the configuration in which the external controller 102 is connected. That is, the printing system may be configured such that the image forming apparatus 101 is connected to the external LAN 104 and the client PC 103 transmits print data processible by the image forming apparatus 101.

In this case, the image forming apparatus 101 performs data analysis or rasterizing processing and executes print processing. A Patlite® 112 displays the state of a print job under execution. The Patlite® 112 changes the lighting color depending on the states of consumables and devices relating to job execution, such as the remaining paper amount, the remaining toner amount, and the waste toner storage states of the waste toner containers, thereby announcing to the user the current state of the print job. The relationship between detailed lighting patterns and print job states will be described below.

Figure 2:
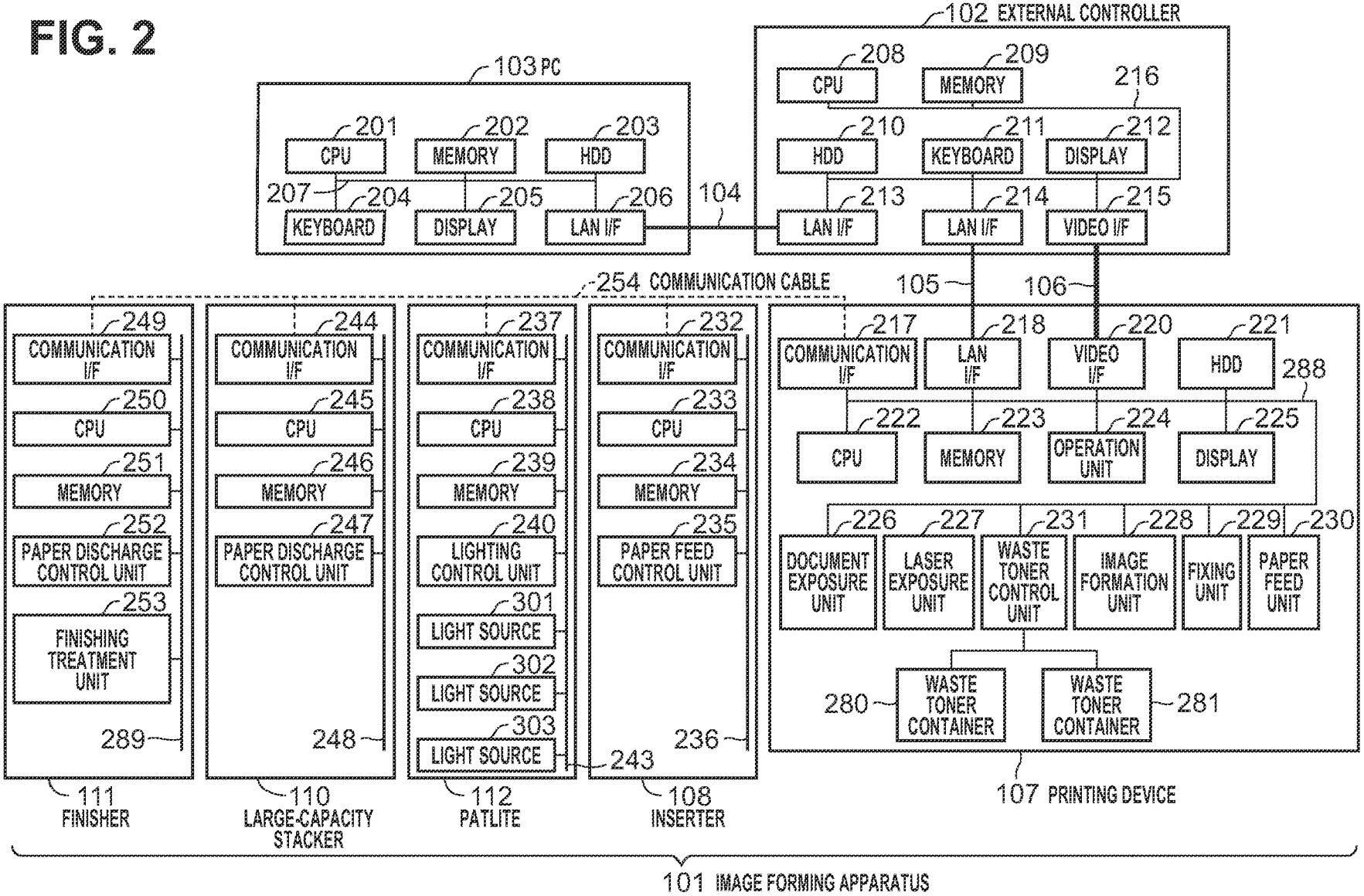
FIG. 2 is a block diagram illustrating a system configuration of the printing system.

FIG. 2 is a block diagram illustrating a system configuration of the image forming apparatus 101, the external controller 102, and the client PC 103.

First, the configuration of the printing device 107 in the image forming apparatus 101 will be described. The printing device 107 in the image forming apparatus 101 includes a communication interface (I/F) 217, a LAN I/F 218, a video I/F 220, a hard disk drive (HDD) 221, a central processing unit (CPU), a memory 223, an operation unit 224, and a display 225. The printing device 107 in the image forming apparatus 101 further includes a document exposure unit 226, a laser exposure unit 227, an image formation unit 228, a fixing unit 229, and a paper feed unit 230. These configuration elements are connected via a system bus 288.

The communication I/F 217 is connected to the inserter 108, the Patlite® 112, the large-capacity stacker 110, and the finisher 111 via a communication cable 254, thereby communication is performed to control these devices.

The LAN I/F 218 is connected to the external controller 102 via the internal LAN 105 to communicate print data and the like.

The video I/F 220 is connected to the external controller 102 via the video cable 106 to communicate image data and the like.

The HDD 221 is a storage device in which programs and data are saved. A CPU 222 comprehensively performs image processing control and printing control based on the programs stored in the HDD 221. The memory 223 acts as a work area to store programs used for the CPU 222 to perform various processes and image data. The operation unit 224 accepts inputs of various settings and instructions for operations from the user.

The display 225 displays setting information of the image processing apparatus and the processing status of a print job. The document exposure unit 226 reads a document when the copy function or the scan function is used. The document exposure unit 226 reads document data by capturing an image through a charge-coupled device (CCD) camera while illuminating the paper sheet placed by the user with an exposure lamp. The laser exposure unit 227 is a device that performs primary charging for irradiating a photosensitive drum with laser light for transferring a toner image and performs laser exposure. The laser exposure unit 227 performs primary charging to charge the photosensitive drum surface at a uniform negative potential.

The laser exposure unit 227 then irradiate the photosensitive drum with laser light using a laser driver while adjusting the reflection angle with a polygon mirror. Negative charge at the irradiated part is thereby neutralized to form an electrostatic latent image. The image formation unit 228 is a device that transfers toner onto a paper sheet. The image formation unit 228 includes a development unit, a transfer unit, and a toner supply unit, and transfers toner on the photosensitive drum onto the paper sheet.

The development unit adheres the negatively charged toner from a development cylinder onto the electrostatic latent image on the photosensitive drum to turn the electrostatic latent image into a visible image. The transfer unit performs primary transfer of applying a positive potential to a primary transfer roller and transferring the toner from the photosensitive drum onto a transfer belt, and performs secondary transfer of applying a positive potential to a secondary transfer roller and transferring the toner from the transfer belt onto the paper sheet. The fixing unit 229 is a device that melts and fixes the toner on the paper sheet a by heat and pressure. The fixing unit 229 includes a heater, a fixing belt, and a pressuring belt. The paper feed unit 230 is a device that feeds a paper sheet, and controls the feeding operation and conveyance operation of the paper sheet using a roller and various sensors.

The waste toner control unit 231 controls a mechanism for cleaning after the toner transfer to the paper sheet and a mechanism for conveying waste toner to the waste toner container. The waste toner control unit 231 also acquires the storage states of the waste toner containers detected by the waste toner container detection sensors 607 and 608, and notifies the acquired states to a light source control unit 240 of the Patlite® 112. Specifically, if the waste toner container detection sensors 607 and 608 illustrated in FIG. 6 do not detect insertion of the waste toner containers, the waste toner control unit 231 notifies the state of absence of the waste toner containers to the light source control unit 240 of the Patlite® 112. The detection of the waste toner storage state and the management of the waste toner storage state in the memory 223 are performed for each of the waste toner container detection sensors 607 and 608. The light source control unit 240 stores in a memory 239 the waste toner storage states notified by the printing device 107.

The waste toner control unit 231 further acquires the storage states of the waste toner container detection sensors 607 and 608 detected by the near-full level detection sensors 603 and 604 and the full level detection sensors 605 and 606, and notifies the storage states to the light source control unit 240 of the Patlite® 112. Specifically, if the surface of the accumulated waste toner exceeds a first threshold illustrated by a dashed line, the near-full level detection sensors 603 and 604 detect the waste toner's near-full state. The waste toner control unit 231 then notifies a waste toner's near-full state to the light source control unit 240 of the Patlite® 112. At this time, the full level detection sensors 605 and 606 do not detect the waste toner.

Similarly, if the surface of the accumulated waste toner exceeds a second threshold illustrated by a dashed line (indicating a larger amount of waste toner than that indicated by the first threshold), the full level detection sensors 605 and 606 detect a waste toner's full state. Then, the waste toner control unit 231 notifies the light source control unit 240 of the Patlite® 112 of the waste toner full state. At this time, the near-full level detection sensors 603 and 604 detect the waste toner.

If the container that is the discharge destination of the waste toner becomes full during execution of a print job, the waste toner control unit 231 determines whether it is possible to discharge the toner to the other waste toner container. If determining that it is possible, the waste toner control unit 231 switches the discharge destination to the other waste toner container.

A configuration of the inserter 108 in the image forming apparatus 101 will now be described. The inserter 108 in the image forming apparatus 101 includes a communication I/F 232, a CPU 223, a memory 234, and a paper feed control unit 235, and these constituent elements are connected together via a system bus 236. The communication I/F 232 is connected to the printing device 107 via the communication cable 254 to perform communication for control. The CPU 233 performs various controls for paper feeding based on control programs stored in the memory 234.

The memory 234 is a storage device in which the control programs are stored. The paper feed control unit 235 controls the feeding and conveyance of the paper sheet conveyed from the paper feeding unit of the inserter 108 or the printing device 107.

A configuration of the Patlite® 112 will now be described. The Patlite® 112 includes a communication I/F 237, a CPU 238, a memory 239, and the light source control unit 240, and these constituent elements are connected together via a system bus 243. The communication I/F 237 is connected to the printing device 107 via the communication cable 254 to perform communication for control.

The CPU 238 performs various controls for the Patlite® 112, based on control programs stored in the memory 239. The memory 239 is a storage device in which the control programs are saved. The light source control unit 240 controls turning on and off of a light source unit for a specified color based on instructions from the CPU 238.

Upon receipt of an instruction for turning on from the light source control unit 240, a light source unit 301, a light source unit 302, and a light source unit 303 shift from the off state to the on state. Upon receipt of an instruction for turning off, the light source unit 301, the light source unit 302, and the light source unit 303 shift from the on state to the off state. In the present exemplary embodiment, the light source unit 301 has a green light emitting diode (LED), the light source unit 302 an orange LED, and the light source unit 303 a red LED. However, these units may have different color LEDs or different light emitting media. Furthermore, three light source units are provided here as an example, but the number of light source units is not limited as long as a plurality of light source parts is provided.

The CPU 238 refers to the waste toner storage state acquired from the waste toner control unit 231 and the states of the various devices and consumables in the printing device 107 via the communication cable 254, and instructs the light source control unit 240 to turn on the light source units of the Patlite® 112.

A configuration of the large-capacity stacker 110 in the image forming apparatus 101 will now be described. The large-capacity stacker 110 in the image forming apparatus 101 includes a communication V/F 244, a CPU 245, a memory 246, and a paper discharge control unit 247, and these constituent elements are connected together via a system bus 248. The communication I/F 244 is connected to the printing device 107 via the communication cable 254 to perform communication for control. The CPU 245 performs various controls for paper discharge based on control programs stored in the memory 246. The memory 239 is a storage device in which the control programs are stored. The paper discharge control unit 247 performs controls for conveying the paper sheets to a stack tray, an escape tray, or the finisher 111 in the subsequent stage, based on instructions from the CPU 245.

A configuration of the finisher 111 in the image forming apparatus 101 will now be described. The finisher 111 in the image forming apparatus 101 includes a communication I/F 249, a CPU 250, a memory 251, a paper discharge control unit 252, and a finishing treatment unit 253, and these constituent elements are connected together via a system bus 289. The communication I/F 249 is connected to the printing device 107 via the communication cable 254 to perform communication for control. The CPU 250 performs various controls for finishing treatments and paper discharge based on control programs stored in the memory 251. The memory 251 is a storage device in which the control programs are stored. The paper discharge control unit 252 controls the conveyance and discharge of paper sheets based on instructions from the CPU 250. The finishing treatment unit 253 controls finishing treatments, such as stapling, punching, and saddle stitch binding, based on instructions from the CPU 250.

A configuration of the external controller 102 will now be described. The external controller 102 includes a CPU 208, a memory 209, an HDD 210, a keyboard 211, a display 212, a LAN I/F 213, a LAN I/F 214, and a video I/F 215, and these units are connected together via a system bus 216. The CPU 208 comprehensively executes processes, such as reception of print data from the client PC 103, raster image processing (RIP) processing, and transmission of print data to the image forming apparatus 101, based on the programs and data saved in the HDD 210. The memory 209 stores programs and data used for the CPU 208 to perform various processes, and acts as a work area. The HDD 221 stores programs and data used for operations such as print processing. The keyboard 211 is a device for inputting an operation instruction for the external controller 102. The display 212 displays information on an application executed by the external controller 102, by using still images or motion video images. The LAN I/F 213 is connected to the client PC 103 via the external LAN 104 to communicate a print instruction and the like.

The LAN I/F 214 is connected to the image forming apparatus 101 via the internal LAN 105 to communicate a print instruction and the like. The video I/F 215 is connected to the image forming apparatus 101 via the video cable 106 to communicate print data and the like.

A configuration of the client PC 103 will now be described. The client PC 103 includes a CPU 201, a memory 202, an HDD 203, a keyboard 204, a display 205, and a LAN O/F 206, and these units are connected together via a system bus 207. The CPU 201 creates print data or issues a print instruction, based on a document processing program or the like stored in the HDD 203. The CPU 201 also comprehensively controls the devices connected to the system bus. The memory 202 stores programs and data used by the CPU 201 to perform various processes, and acts as a work area. The HDD 203 stores programs and data used for operations such as print processing. The keyboard 204 is a device for inputting an operation instruction for the client PC 103. The display 205 displays information on an application executed by the client PC 103, by using still images or motion video images.

The LAN I/F 206 is connected to the external LAN 104 to communicate a print instruction and the like.

In the above description, the external controller 102 and the image forming apparatus 101 are connected via the internal LAN 105 and the video cable 106. However, the external controller 102 and the image forming apparatus 101 may be configured to transmit and receive data for printing. For example, the external controller 102 and the image forming apparatus 101 may be connected via only a video cable. The memories 202, 209, 223, 234, 239, 246, and 251 may be storage devices for holding data and programs. For example, these memories may be replaced with volatile RAMs, non-volatile ROMs, built-in HDDs, external HDDs, or USB memories.

Figure 3:
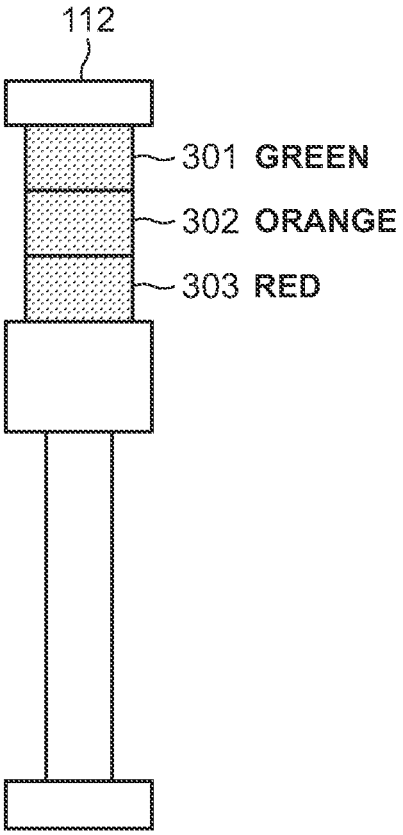
FIG. 3 is a schematic view of a Patlite® mounted on an image forming apparatus.

FIG. 3 is a schematic view of the Patlite® 112 mounted on the image forming apparatus 101. The Patlite® 112 announces the state of a print job under execution to the user by turning on a light source corresponding to a predetermined color among the light source units 301 to 303.

The CPU 238 of the Patlite® 112 controls the lighting states of the light source units 301 to 303, based on the states of the waste toner collection containers notified by the printing device 107 at the time of execution of a print job. If there occurs no factor to stop the print job, the CPU 238 of the Patlite® 112 turns on the light source unit 301 (green) to notify "the print job is under normal execution".

If there occurs a factor that disables continuation of the print job in a short time, the CPU 238 of the Patlite® 112 turns on the light source unit 302 (orange) to give an "advance notice of suspension of the print job", and notifies in advance the user that the print job will be stopped. Any content of the notification may be employed as long as the use's attention is attracted by turning on the light source unit 303 (orange). For example, the content of the notification may be an "advance notice of error" or a "request for preparation of a new waste toner container".

If there occurs a factor that immediately disables the continuation of the print job, the CPU 238 of the Patlite® 112 turns on the light source unit 303 (red) to notify "the print job is under suspension", for example. Any content of the notification may be employed as long as the user is alarmed by turning on the light source unit 303 (red). For example, the content of the notification may be "occurrence of an error" or "request for replacement of the waste toner container".

FIG. 4 is a diagram representing the states of the two waste toner containers in the printing device 107 and the lighting patterns of the Patlite® 112. For convenience of the description, the two waste toner containers are designated as a waste toner container A and a waste toner container B, and the discharge destination of waste toner at the time of lighting pattern determination is set to the waste toner container A. The relationship between the lighting color of the Patlite® 112 and the print job state is as described above. The image forming apparatus 101 can detect four states of accumulated amount of waste toner with respect to the total capacities of the waste toner containers. The four states will be defined below.

The detected state "not near-full" is a state where the waste toner container can contain further waste toner and is not close to full (half of the full capacity or less). Specifically, this state is a state where the near-full level detection sensor 603 and the full level detection sensor 605 do not detect the waste toner in the waste toner container 280, and the near-full level detection sensor 604 and the full level detection sensor 606 do not detect the waste toner in the waste toner container 281.

The detected state "near-full" is a state where the waste toner container can contain further waste toner but is short of the full capacity by a predetermined volume. Specifically, this state is a state where the near-full level detection sensor 603 detects the waste toner and the full level detection sensor 605 does not detect the waste toner in the waste toner container 280, and the near-full level detection sensor 604 detects the waste toner and the full level detection sensor 606 does not detect the waste toner in the waste toner container 280.

The detected state "full" is a state where the waste toner container is full with waste toner (the waste toner is accumulated up to the volume by which the container is regarded as being full of the total capacity). Specifically, the state is a state where the near-full level detection sensor 603 and the full level detection sensor 605 detect the waste toner in the waste toner container 280, and the near-full level detection sensor 604 and the full level detection sensor 606 detect the waste toner in the waste toner container 281.

The detected state "no bottle" is a state where no waste toner container is placed or the waste toner container is wrongly placed. Specifically, the state is a state where the waste toner container detection sensor 607 does not detect the waste toner container 280 and the waste toner container detection sensor 608 does not detect the waste toner container 281. Although not described here, the detected state "with bottle" is a state where the waste toner container is placed or correctly placed. Specifically, the state is a state where the waste toner container detection sensor 607 detects the waste toner container 280 and the waste toner container detection sensor 608 detects the waste toner container 281.

In the lighting patterns of FIG. 4, the lighting color is green, that is, "the print job is under normal execution" is announced to the user in a case where one of the waste toner containers A and B is not in a near-full state. Even in a case where the container as the current discharge destination is in a full state or a near-full state, long-time printing is possible by the printing device 107 changing the discharge destination of waste toner if the other container is not in a near-full state. Thus, in the case described above, no advance notice of suspension of the print job is given to the user.

In the lighting patterns of FIG. 4, the cases where the lighting color is red, i.e., the cases where "the print job is under suspension" is announced to the user, are the cases where there is no container to which the discharge destination can be switched and the waste toner container as the current discharge destination is full. Specifically, as in the cases of No. 11 and 12, it is not possible to convey the waste toner if the waste toner container A as the current discharge destination becomes full while the reserve waste toner container B is full or is not inserted. Thus, the suspension of the print job is announced to the user.

In the lighting patterns of FIG. 4, the cases where the lighting color is orange, i.e., the cases where the "advance notice of suspension of the print job" is announced to the user, are the two cases described below: the first case where the waste toner container A is in a near-full state while the waste toner container B is in a near-full state, or in a full state, or no other bottle is inserted; the second case where the waste toner container A is in a full state while the waste toner container B is in a near-full state. Specific examples of the first case are No. 6 to 8. In this case, it is difficult to discharge the waste toner to the current discharge destination for a long time and the discharge destination cannot be switched to a reserve container or can be switched to the reserve container but long-time discharge of waste toner to the reserve container is difficult. Specific example of the second case is No. 10 where the bottle as the current discharge destination is full and long-time discharge of waste toner to the switched discharge destination is difficult.

Figure 5:
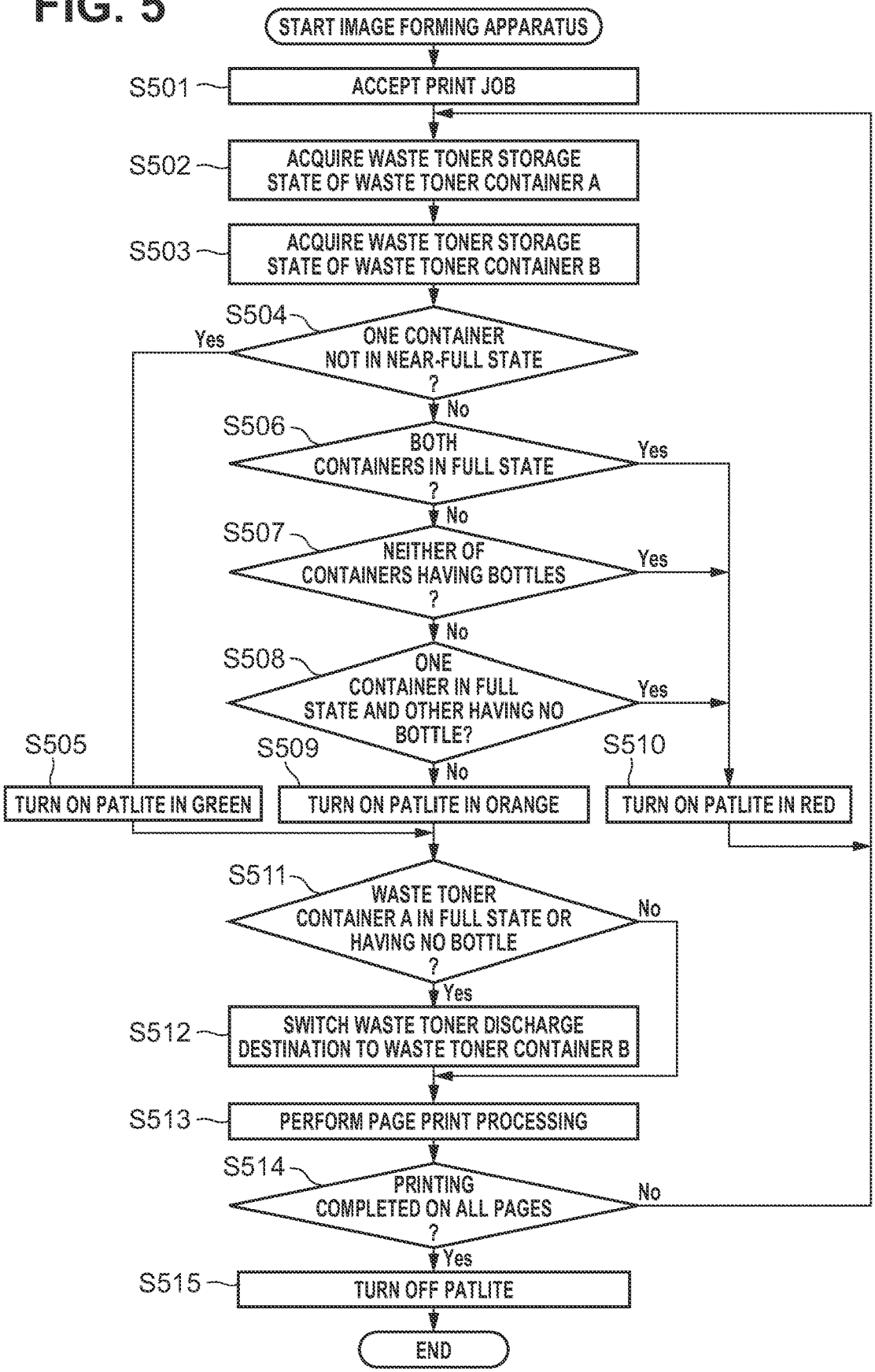
FIG. 5 is a flowchart of light source control of the Patlite® on the image forming apparatus during execution of a print job.

FIG. 5 is a flowchart of lighting control of the Patlite® based on the states of the two waste toner containers during execution of a print job performed by the image forming apparatus 101.

The process illustrated in FIG. 5 is executed by the CPU 238 of the Patlite® 112 and the CPU 222 of the printing device 107.

In step S501, the printing device 107 receives a print job from the external controller 102. In steps S502 and S503, the CPU 238 of the Patlite® 112 acquires the waste toner storage states of the waste toner container A that is the current discharge destination of waste toner and the reserve waste toner container B, from the printing device 107 via the communication cable 254.

In step S504, the CPU 238 of the Patlite® 112 determines whether either of the waste toner containers A and B is not in a near-full state. If either of the waste toner containers is not in a near-full state (YES in step S504), the processing proceeds to step S505. In step S505, the CPU 238 of the Patlite® 112 instructs the light source control unit 240 to turn on the light source unit 301 (green). If either of the waste toner containers is not in a near-full state, long-time printing is possible using the waste toner container as the current discharge destination or the reserve waste toner container, and thus "the print job is under normal execution" is announced to the user.

If the CPU 238 determines that neither of the waste toner containers are not in a near-full state (NO in step S504), the processing proceeds to step S506. Steps S506 to S508 are performed for determinations on whether to turn on the Patlite® 112 in red. In step S506, the CPU 238 of the Patlite® 112 determines whether both the waste toner containers A and B are in a full state. In step S507, the CPU 238 of the Patlite® 112 determines whether no waste toner container is inserted into the waste toner container inlet 109. In step S508, the CPU 238 of the Patlite® 112 determines whether the waste toner's storage state of one of the waste toner containers is full and the other waste toner container is not inserted.

If the determination result is TRUE in any of steps S506 to S508 (YES in any of steps S506 to S508), the processing proceeds to step S510. In step S510, the CPU 238 of the Patlite® 112 instructs the light source control unit 240 to turn on the light source unit 303 (red). If the determination result is TRUE in all steps S506 to step S508, the waste toner can no longer be conveyed and thus "the print job is under suspension" is announced to the user. If the Patlite® 112 is turned on in red, the processing returns to step S502. In step S502, the CPU 238 of the Patlite® 112 acquires again the waste toner storage states of the waste toner containers A and B. The light source control unit 240 maintains the light source unit 303 turned on in red until the cause for red light is eliminated.

If the determination result is FALSE in all steps S504 to S508 (NO in steps S504 to S508), the CPU 238 of the Patlite® 112 instructs the light source control unit 240 to turn on the light source unit 302 (orange). In this case, the orange light indicates that the conveyance of the waste toner may become difficult and the printing will not be able to continue in a short time, and an "advance notice of suspension of the print job" is given to the user.

If the Patlite® 112 is turned on in green or orange, the processing proceeds to step S511. In step S511, the CPU 222 of the printing device 107 determines whether the waste toner storage state of the waste toner container A that is the current discharge destination of waste toner is full or the waste toner container A is not inserted into the waste toner container inlet 109. Thai is, the CPU 222 of the printing device 107 determines whether it is possible to convey the waste toner to the current discharge destination. If the determination result is TRUE in step S511 (YES in step S511), it is not possible to convey the waste toner to the current discharge destination. Thus, in step S512, the CPU 222 of the printing device 107 instructs the waste toner control unit 231 to switch the discharge destination to the waste toner container B. If the destination result is FALSE in step S511 (NO in step S511), that is, if the CPU 222 of the printing device 107 determines that it is possible to convey the waste toner to the current discharge destination, the processing proceeds to step S513 without changing the discharge destination.

In step S513, the image forming apparatus 101 performs a print process on the current page. In step S514, the CPU 222 of the printing device 107 determines whether printing has completed on all pages. If printing on all the pages have not yet completed on all the pages (NO in step S513), the processing returns to step S502. In step S502, the CPU 222 of the printing device 107 determines again the lighting color in which the Patlite® 112 is to be turned on with reference to the states of the two waste toner containers. If it is determined that printing has completed on all the pages (YES in step S514), the CPU 222 of the printing device 107 regards that the process of the print job has completed. In step S515, the CPU 238 of the Patlite® 112 instructs the light source control unit 240 to turn off any of the light source units 301 to 303 that is in the on state. In this configuration, any light source is turned off in step S515, but the present embodiment is not limited to this configuration. For example, if the light source unit 303 (red) is on, the light source unit 303 may be maintained turned on in step S515. If the light source unit 302 (orange) is on, the light source unit 302 may also be maintained turned on in step S515.

In this example, the lighting control process is performed at the time of execution of a print job. However, the lighting control process may be performed at any timing after the image forming apparatus 101 is powered on. For example, the lighting control process may be started when the image forming apparatus 101 is powered on and the activation is completed. In that case, step S501 is performed before step S513 and after step S511 (NO) or step S512. If the lighting control process is started when the image forming apparatus 101 is powered on and completely activated, the Patlite® 112 may be turned off (performed in step S515 in the above description) after the image forming apparatus 101 is powered off. In that case, steps S501, S513, and S514 are not performed, and a step of determining whether the image forming apparatus 101 has been powered off is provided after step S512. If it is determined that the image forming apparatus 101 has been powered off, the process is ended. If it is determined that the image forming apparatus 101 has not been powered off, the processing returns to step S502.

Various examples and exemplary embodiments of the present disclosure have been described above. However, the gist and scope of the present disclosure are not limited by specific description herein.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, the scope of the following claims is to be accorded the broadest interpretation so as to encompass all such modifications and equivalent structures and functions.

This application claims the benefit of Japanese Patent Application No. 2021-091610, filed May 31, 2021, which is hereby incorporated by reference herein in its entirety.

What is claimed is:

1. An image forming apparatus comprising:

a first waste toner container and a second waste toner container configured to accumulate waste toner; and a controller configured to acquire information on an accumulation state of the waste toner in the first waste toner container and information on an accumulation state of the waste toner in the second waste toner container, wherein the image forming apparatus further comprises a notification device configured to control a plurality of light sources including a first light source configured to issue, by lighting, a warning of a first level regarding a waste toner container and a second light source configured to issue, by lighting, a warning of a second level regarding a waste toner container, the second level being higher than the first level, wherein the notification device does not turn on the first light source and the second light source if the first waste toner container is in a first state and if the second waste toner container is not in a second state but in a third state, the first state being a state where an accumulated amount of waste toner is full with respect to a first total capacity, the second state being a state where an accumulated amount of waste toner is full with respect to a second total capacity, the third state being a state where the accumulated amount of waste toner has not exceeded a predetermined accumulated amount with respect to the second total capacity, and wherein the notification device does not turn on the second light source and turns on the first light source if the first waste toner container is in the first state and the second waste toner container is in a fourth state, the fourth state being a state where the accumulated amount of waste toner has exceeded the predetermined accumulated amount with respect to the second total capacity.

2. The image forming apparatus according to claim 1, wherein the notification device does not turn on the first light source and turns on the second light source if the first waste toner container is in the first state and the second waste toner container is in the second state.

3. The image forming apparatus according to claim 1, wherein the notification device does not turn on the first light source and the second light source if the first waste toner container is in a fifth state and the second waste toner container is in the fourth state, the fifth state being a state where the accumulated amount of waste toner has exceeded a predetermined accumulated amount with respect to the first total capacity of the first waste toner container.

4. The image forming apparatus according to claim 3, wherein the notification device does not turn on the second light source and turns on the first light source if the first waste toner container is in the fifth state and the second waste toner container is in the second state.

5. The image forming apparatus according to claim 3, wherein the notification device does not turn on the first light source and the second light source if the first waste toner container is not in the first state or the fifth state.

6. The image forming apparatus according to claim 1, wherein the notification device does not turn on the first light source and the second light source if the second waste toner container is not in the second state or the fourth state.

7. The image forming apparatus according to claim 1, comprising:

a first sensor configured to detect that the accumulated amount of waste toner is full with respect to a total capacity of the first waste toner container;

a second sensor configured to detect that the accumulated amount of waste toner with respect to the total capacity of the first waste toner container has exceeded a predetermined volume;

a third sensor configured to detect that the accumulated amount of waste toner with respect to a total capacity of the second waste toner container is full; and a fourth sensor configured to detect that the accumulated amount of waste toner with respect to the total capacity of the second waste toner container has exceeded a predetermined volume, wherein the first sensor, the second sensor, the third sensor, and the fourth sensor transmit detection results to the controller.

8. The image forming apparatus according to claim 7, comprising:

a fifth sensor configured to detect whether the second waste toner container is placed, and wherein the notification device does not turn on the first light source and turns on the second light source if the first waste toner container is in the first state and the fifth sensor detects that the second waste toner container is not placed, wherein the fifth sensor is a sensor different from the first sensor, the second sensor, the third sensor, and the fourth sensor.

9. The image forming apparatus according to claim 8, comprising:

a sixth sensor configured to detect whether the first waste toner container is placed;

wherein the notification device does not turn on the first light source and turns on the second light source if the second waste toner container is in the second state and the fifth sixth sensor detects that the second waste toner container is not placed, and wherein the sixth sensor is a sensor different from the first sensor, the second sensor, the third sensor, the fourth sensor, and the fifth sensor.

10. The image forming apparatus according to claim 8, wherein the notification device does not turn on the second light source and turns on the first light source if the second waste toner container is in the fourth state and the fifth sensor detects that the first waste toner container is not placed.

11. The image forming apparatus according to claim 1, further comprising an acceptance interface (IF) configured to accept a print job, wherein the notification device includes a third light source configured to indicate, by lighting, that the image forming apparatus is normal, and wherein, when the acceptance IF accepts the print job, the notification device does not turn on the first light source and the second light source and turns on the third light source.

12. The image forming apparatus according to claim 11, wherein, in response to the acceptance IF completing execution of the print job, the notification device turns off the third light source having been turned on.

13. A control method of an image forming apparatus, the image forming apparatus including:

a first waste toner container and a second waste toner container configured to accumulate waste toner; and a controller configured to acquire information on an accumulation state of the waste toner in the first waste toner container and information on an accumulation state of the waste toner in the second waste toner container; and a notification device configured to control a plurality of light sources including a first light source configured to issue, by lighting, a warning of a first level regarding a waste toner container and a second light source configured to issue, by lighting, a warning of a second level regarding a waste toner container, the second level being higher than the first level, the control method of an image forming apparatus comprising:

acquiring the information on the accumulation state of the waste toner in the first waste toner container and the information on the accumulation state of the waste toner in the second waste toner container;

not turning on the first light source and the second light source if the first waste toner container is in a first state and the second waste toner container is not in a second state but in a third state, the first state being a state where an accumulated amount of waste toner is full with respect to a first total capacity, the second state being a state where an accumulated amount of waste toner is full with respect to a second total capacity, the third state is a state where the accumulated amount of waste toner has not exceeded a predetermined accumulated amount with respect to the second total capacity, and not turning on the second light source and turning on the first light source if the first waste toner container is in the first state and the second waste toner container is in a fourth state, the fourth state is a state where the accumulated amount of waste toner has exceeded the predetermined accumulated amount with respect to the second total capacity.

* * * * *